United States Patent [19]

Matsumoto

[11] 4,423,678

[45] Jan. 3, 1984

[54] APPARATUS FOR ENGAGING IMPRESSION CYLINDER

[75] Inventor: Katsutoshi Matsumoto, Kyoto, Japan

[73] Assignee: Dainippon Screen Mfg. Co., Ltd., Japan

[21] Appl. No.: 384,916

[22] Filed: Jun. 4, 1982

[30] Foreign Application Priority Data

Jun. 23, 1981 [JP] Japan ..... 56-98005

[51] Int. Cl.[3] ..... B41F 13/24

[52] U.S. Cl. ..... 101/248; 101/283

[58] Field of Search ..... 101/248, 216, 245, 283, 101/247, 145

[56] References Cited

U.S. PATENT DOCUMENTS

| | | | |
|---|---|---|---|
| 2,982,206 | 5/1961 | Peyrebrune | 101/248 X |
| 3,057,292 | 10/1962 | Larsen | 101/248 |
| 3,073,997 | 1/1963 | Tagliasacchi | 101/248 X |
| 3,143,962 | 8/1964 | Dobson et al. | 101/248 |
| 3,308,752 | 3/1967 | Stevenson | 101/248 |
| 3,358,595 | 12/1967 | Lindemann | 101/248 |
| 3,413,921 | 12/1968 | Boatman | 101/248 |
| 3,662,472 | 5/1972 | Johnson | 101/248 |
| 3,969,826 | 7/1976 | Ottenhues et al. | 101/248 |
| 4,309,945 | 1/1982 | Marion | 101/248 |
| 4,363,270 | 12/1982 | Ury et al. | 101/248 X |

*Primary Examiner*—E. H. Eickholt

*Attorney, Agent, or Firm*—Brumbaugh, Graves, Donohue & Raymond

[57] ABSTRACT

An impression cylinder is adapted to be disengaged from a plate cylinder after an image area of printing plate attached thereon has passed through the contact point where the cylinders abut each other, but before the trailing end of an object that is printed will pass through said contact point. The disengagement as well as the engagement of said cylinders are controlled by means of a mechanism comprising scale disks each of which has an adjustable angle index and is driven to rotate synchronously with the plate cylinder.

3 Claims, 7 Drawing Figures

APPARATUS FOR ENGAGING IMPRESSION CYLINDER

BACKGROUND OF THE INVENTION

The present invention relates to an improvement in an apparatus for engaging an impression cylinder with a plate cylinder by which apparatus objects fed thereto are pressed between said two cylinders so as to be printed.

In the printing of name plates or printed circuits, it is usual to utilize such a material as a metallic or plastic sheet which is comparatively thick, hard and incompressible under printing pressure.

In the known apparatuses, the objects that are to be printed are supplied into the contact zone which is formed between a plate cylinder and an impression cylinder by urging the latter to engage with the former. Therefore, edges of said hard objects cause a sudden severe change in the pressure applied to printing plates when said objects enter or leave the contact zone between said two cylinders. The sudden pressure changes have hitherto been injurious to the surfaces of the printing plates.

BRIEF SUMMARY OF THE INVENTION

An object of this invention is, therefore, to provide an apparatus which has a structure such that the aforementioned disadvantages in the prior art are overcome. A particular object of the invention is to provide a printing apparatus having an impression cylinder which is periodically separated from a plate cylinder in such a manner that the contact between the two cylinders and a printed object interposed therebetween is broken after the image area of a printing plate attached on the plate cylinder has passed through the contact zone, but before the trailing end of said printing plate will pass therethrough. The abovementioned motion of the impression cylinder is controlled by means of the angular phases or positions of the plate cylinder that is rotating at a stationary position. Other objects and merits of the invention will be appreciated by the following description of an embodiment.

DETAILED DESCRIPTION OF THE INVENTION

An embodiment of the invention will be described in detail with reference to the drawings.

The numeral 12 indicates, for instance, an intaglio printing plate attached onto the surface of a plate cylinder 11. The numeral 13 indicates an impression cylinder with an outer surface covered with a blanket, and the numeral 14 shows an object or material such as a plastic base sheet that is supplied into the printing position (P) by a feeder and a guiding marker (both being not illustrated) so as to be prined thereat.

Figure 3:
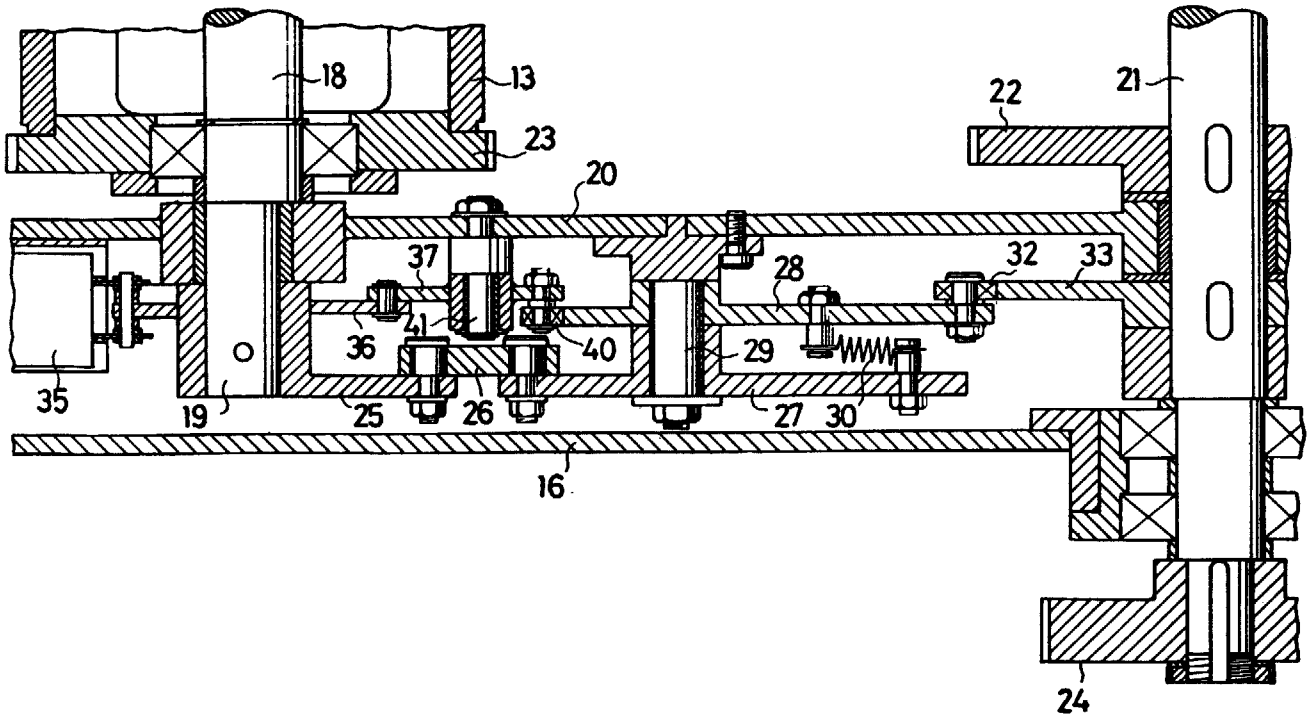
FIG. 3 is a cross sectional development of the cam mechanism shown in FIG. 2 and including a frame which is not shown in FIGS. 1 and 2.

The plate cylinder 11 has a shaft 15 secured to both the side webs of said cylinder and rotatably journaled by bearing units (not shown) which are fixed to a frame work 16 (FIG. 3) so that said cylinder can be driven to rotate at a stationary position by means of a spur gear 17 which in turn is driven by a drive shaft (not shown) having a pinion engaging with the spur gear.

The impression cylinder 13 also has a shaft 18 by which each of the side webs of said cylinder is supported with an interposed ball bearing whose inner race is secured to said shaft 18 whereas the outer race of said bearing is secured to each of said webs. Thus, the shaft 18 is not forcibly driven to rotate but is freely journaled at its eccentric neck ends 19 by the bearing portions of a support lever 20. The other shaft 21 serves as a drive shaft for the impression roller 13 as well as a holding shaft of the support lever 20 and is journaled by the frame work 16 with bearing units provided therebetween. The numeral 22 indicates a drive gear affixed to the shaft 21 while the numeral 23 indicates a driven gear affixed to one of the side webs of said impression cylinder. These two gears 22, 23 engage with each other so that the impression cylinder 13 can be driven to rotate in the arrowed direction and with the same peripheral speed as that of the plate cylinder 11 by means of a gear 24 secured at the end of the shaft 21 and a drive pinion (not shown) engaging with said gear 24. An actuating lever 25 for the impression cylinder is secured to one of the eccentric neck ends at its larger end and is connected at its smaller end to one arm of a bell crank 26 via a link 26, the ends of said link being pivoted respectively to said smaller end and said arm. Another bell crank 28 is supported by a pin 29 fixed on the support lever 20 so as to be capable of swinging together with the aforementioned bell crank 27. Both the bell cranks 27, 28 are connected to each other by a tension coiled spring 30 interposed therebetween. A cam follower 32 comprises a miniature bearing which is rotatably provided at the tip end of the longer arm of the bell crank 28. The numeral 33 indicates an actuating cam secured to the drive shaft 21.

Further, the numeral 35 indicates a solenoid of translation type the actuating rod of which is pivotally connected to one arm of a small bell crank 37 via a link 36. The actuating rod is connected also to a protruded arm 38 fixed to the support lever 20, by means of a tension coiled spring 39. The solenoid 35, when energized, will retract its rod to a position shown with a phantom line against the tension of said spring 39. As will be appreciated, the spring 39 pulls out the rod again when the electric current for the solenoid is cut off. The other arm of the small bell crank 37 is provided with a cam follower 40 comprising a miniature bearing rotatably supported by the tip end of said arm, the crank 37 itself being swingably pivoted to the support lever 20 by a pin 41. A further tension coiled spring 42 is stretched between the ends of the longer arm of the bell crank 27 and the protruded arm 38. Bolts 43, 44 serve as stop means adapted to respectively limit the anticlockwise swing motions of the bell cranks 27, 37.

Figures 4, 5, 6, 7:
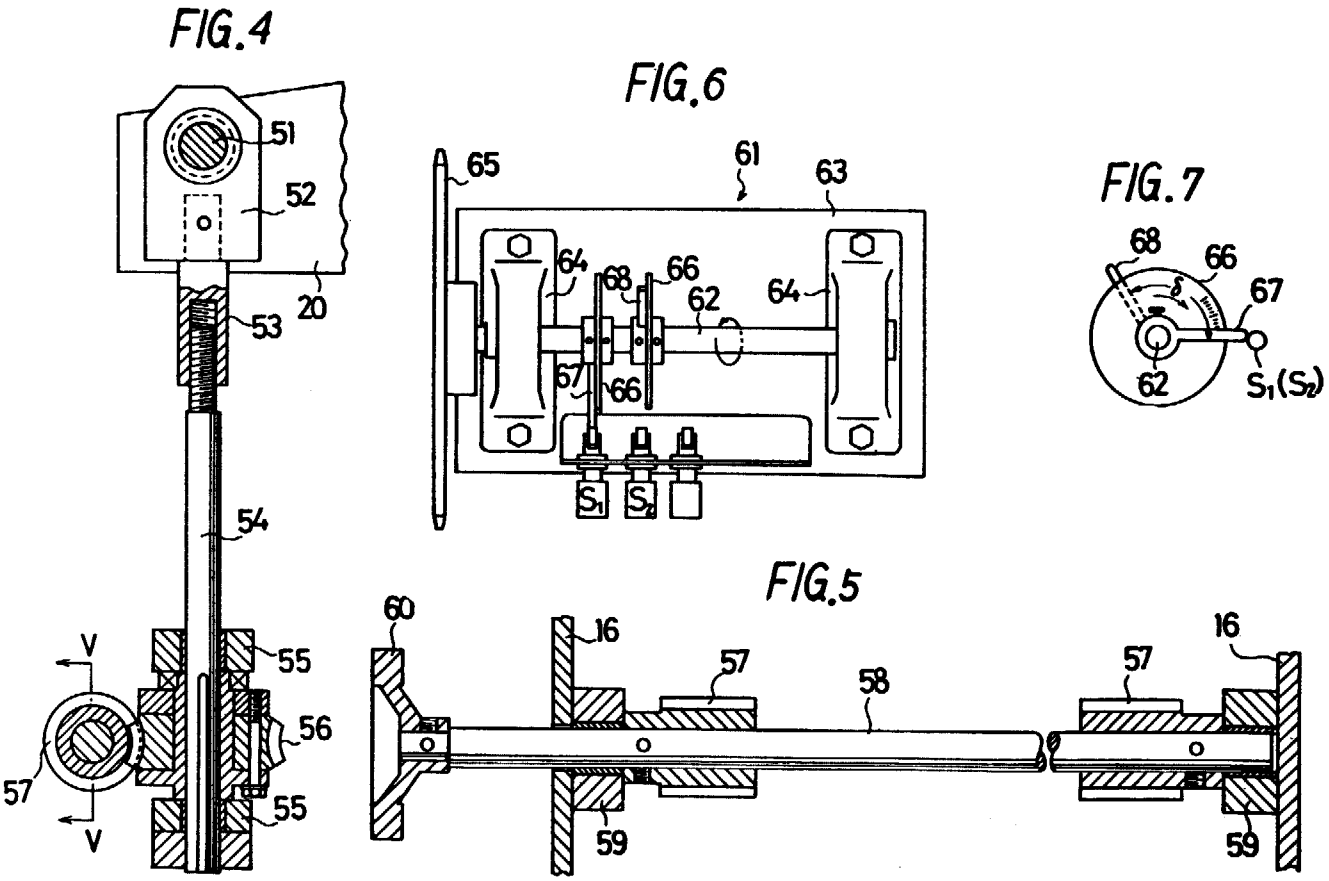
FIG. 4 is a side view, partially in cross section showing a gap adjusting device for controlling a gap between the plate cylinder and an impression cylinder.
FIG. 5 is a front cross sectional view taken along and seen from the line V—V of FIG. 4.
FIG. 6 is a plan view of a sensor device for indicating the rotation angle of the plate cylinder.
FIG. 7 is a partial front elevation showing a scale disk with an angular graduation as well as with angle indices.

FIGS. 4 and 5 illustrate a device for adjustment of a gap or distance between the plate cylinder 11 and the impression cylinder 13, the device including the support lever 20 as an essential member thereof. Namely, a connecting rod 51 interconnects the right and left support levers 20 each having a bracket 52 disposed in contact with the inner surface of said levers and rotatably engaging with the connecting rod 51. The numeral 53 indicates threaded joints each of which is inserted into and fixed respectively at the central lower portions of the brackets. Actuating rods 54 have respectively a male screw at the upper portions thereof so as to be connected to the threaded joint with an adjustability in their insertion depth. A support beam 55 supports the actuating rods 54 and permits them to slide up and down and also to turn about their own axes. The beam is fixed at both the ends thereof to the frame work 16. A drive shaft 58 has worms 57, 57 respectively engaging with one of worm wheels 56, 56 adapted to rotate the actuating rods 54, 54. The drive shaft 58 is also journaled on the frame work 16 by means of bearings 59, 59 such that it may be driven by an operation handle 60.

A sensor device 61 will be now described with reference to FIG. 6 which illustrates a mechanism for detecting and indicating the changes in angular position of the plate cylinder when it rotates around its shaft. A drive shaft 62 has at one end thereof a sprocket wheel 65 and is rotatably supported by bearings 64, 64 that are fixed on a base 63. The sprocket wheel 65 is operatively connected with another sprocket wheel (not shown) having the same pitch diameter and the same number of teeth as those of the former and fixed on the shaft 15 of said plate cylinder 11, said connection being provided by an endless chain spanned between said sprockets. On the other hand, scale disks 66 graduated with angular degrees are affixed to the drive shaft 62. Angle indices 67, 68 respectively have an arm, one side surface of which points to the axis of the shaft 62. Said indices can be set respectively at any desired angular graduation of the scale disks 66. Each of microswitches ($S_1$) ($S_2$) has a contact roller and is fixed on an L-shaped frame mounted on the base 63 such that they are actuated respectively by the corresponding angle indices 67, 68.

An operation of the apparatus outlined hereinbefore will be explained hereinafter.

The intaglio plate 12 is first attached onto the plate cylinder 11. For instance, for the objects or materials 14 such as plastic sheets that are about 1.6 mm thick, it is supposed here that they are supplied by a feeder and a guiding marker into the printing machine so as to be printed therein with thick deposits of ink. Prior to the printing operation, the distance measured at the printing point (P) between the plate cylinder 11 and the impression cylinder 13 will be adjusted by means of the handle 60 to be about 1.3 mm which is slightly smaller than the thickness of said plastic sheets 14. In the above adjustment, the worms 57 drive the worm wheels 56 to rotate the actuating rods 54 screwed into the threaded joints 53, thereby the latter being subsequently shifted upwards or downwards with a result that the support lever is thus slightly swung around the shaft 21. On the other hand, both the plate and impression cylinders 11, 13 are so arranged that they can rotate in the arrowed direction with the same peripheral speed and with the predetermined distance kept constant between the cylinders. The guiding marker, which is not illustrated in the drawings, continues to hold the plastic sheet 14 stationary at a point where the leading end of said sheet may be at, for instance, 5 mm ahead of the printing point (P) until the next step will commence. The aforedescribed apparatus actuates the impression cylinder 13 to abut the plate cylinder when the leading end of the image area in the printing plate arrives at a predetermined position behind the printing point (P) with the rotation of the plate cylinder 11 in the arrowed direction. Thus, the plastic sheet 14 is pressed by the printing plate 12 against the impression cylinder. The detail of the above motion is as follows.

At the time when the impression cylinder is activated, the angular phase of the plate cylinder 11 will be almost constant despite the probable modification in the length of the plate 12 or of the sheet 14, the length being measured in the feeding direction. So, the angle index 67 of the sensor device 61 detecting the angular phase of the plate cylinder can be thus fixed at a proper angle by means of the scale disk 66. The height of the microswitch ($S_1$) will be then adjusted such that the angular phase of the plate cylinder 11 when the impression cylinder is activated to engage therewith may coincide with the printing point (P) at the time when the previously adjusted index 67 will abut the contact roller of said microswitch ($S_1$).

Accordingly, said angle index 67 will be rotated synchronously by the rotation of said plate cylinder 11 so as to actuate the microswitch ($S_1$) to cut off the current to the translational solenoid 35. The link 36 connected to the rod of said solenoid 35 will be pulled out into the position shown with the rigid line in the drawing by means of the tension of the aforementioned coiled spring 39. The small bell crank 37 connected with said link 36 with a pivot pin will be swung subsequently anticlockwise to be hold at a position where the side surface of one arm of said crank will engage with the stop means 44. On the other hand, prior to the above motion of said crank 37, the cam 33 for actuating the impression cylinder is rotated previously by the drive shaft 21 in the arrowed anticlockwise direction so as to swing one of the larger bell cranks 28 into a position shown with rigid line by means of its cam follower 32, from the other position shown with phantom line. The cam continues to rotate thereafter. While the peripheral zone corresponding to a center angle ($\beta$) is kept in contact with said cam follower 32, the abovementioned bell crank 28 is maintained in said position against a torque applied thereto by both the tension springs 30, 42. In the meanwhile, the cam follower 40 of said smaller crank 37 will take the shown position by the aforedescribed mechanism. As the bell crank 28 is swung in the above manner, the thus extended tension spring 30 will force the other larger bell crank 27 to swing anticlockwise around the pin 29 against the tension of the spring 42. Subsequently, said crank 27 is held at a position where its shorter arm rests on the stop means 43. At the same time, said motion of the crank 27 causes the actuating lever 25 to incline toward the left by means of the link 26 pivotally interposed therebetween, thereby resulting in an anticlockwise swing in accordance with a center angle ($\gamma$). The link 26 and the shorter arm of said crank 27 which were in a refracted relation with each other before the motion of the crank 27 will now be stretched straight. The change in the relation will be seen from the drawing showing them with the rigid lines and the phantom lines.

The anticlockwise motion of the actuating lever 25, the degree of which corresponds to the angle ($\gamma$), brings about a rotation of the aforementioned eccentric necks 19 as well as of the shaft 18 in the bearing units to result in a lift by e·sin $\gamma$, the lift effecting thereby an engagement of the impression cylinder 13 with the plate cylinder. The value (e) means an accentricity of said eccentric necks. In an example where the value (e) is 5 mm and the angle ($\gamma$) is 7°, said lift will be about 0.6 mm. The lift is partially absorbed by the compression of said blanket of the impression cylinder 13, but the rest of said lift presses the printing plate whereby an according pressure is given to said plate in the printing operation. A force given as a result of the multiplication of the lateral width, the compressed peripheral length of said printing plate and the strength of said pressure, will be applied back to the eccentric necks 19. The reaction force is transmitted to said necks from said plate 12 through the object that is to printed, and presented as a clockwise moment of force having an arm of the length (e). However, the moment can be borne well by the link 26 and the shorter arm of said bell crank 27 because they are aligned straight in the said state.

Thus, the plastic sheet 14 is printed by the image area of said plate 12 with a thick deposit of ink.

Figure 1:
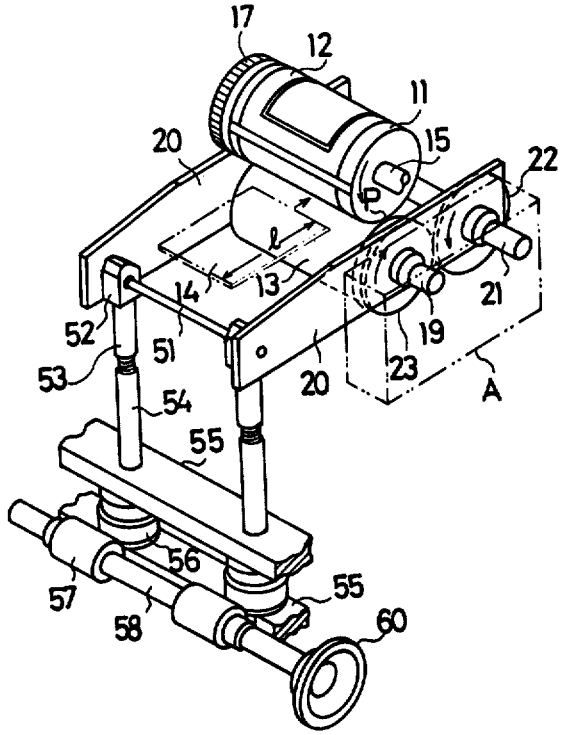
FIG. 1 is a perspective view of an embodiment of the apparatus of the invention shown in relation with a plate cylinder.
Figure 2:
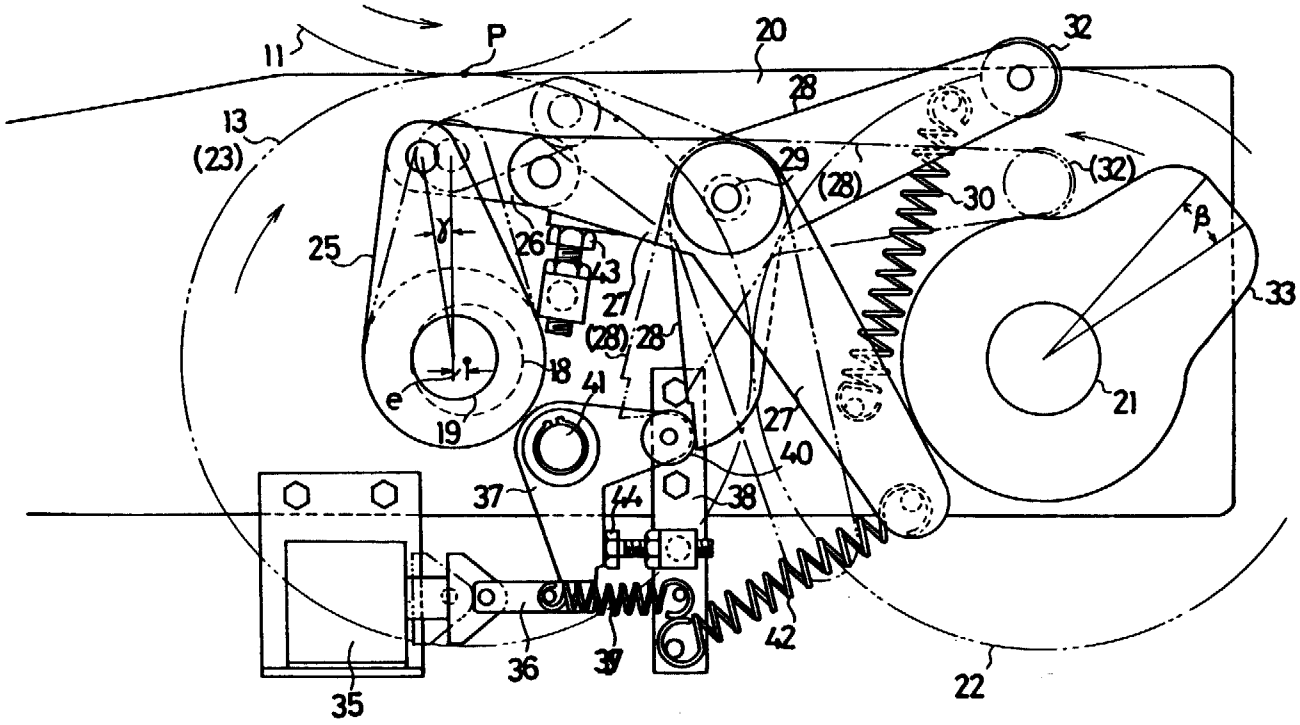
FIG. 2 is a front elevational view of a cam mechanism incorporating a link work as shown in the part A enclosed phantom lines in FIG. 1.

Next described is a mechanism of disengaging or retrieving the impression cylinder. The length (l) of the plastic sheets 14 is, as a matter of course, larger than that of the image area of said printing plate 12 as measured in the feeding direction from its leading end to its trailing end. The entire length (L) of said plate 12 inclusive of its non-image area is in general, however, larger than the length (L) in the feeding direction shown with an arrow in FIG. 1, namely $L>l$. Therefore, if the retrieval of the impression cylinder were controlled after the finish of printing by means of a measure based solely on the length (l) of said plate 12, the trailing end of the plastic sheet 14 would pass over the printing point (P) during the period of the engagement of said impression cylinder with the plate cylinder. In such a case, the hard edge at the trailing end of said sheet 14 might cause a damage to the softer surface of said printing plate 12. Such disadvantage can effectively be avoided by the invented apparatus in the following manner. At first, a length is predetermined by subtracting a proper value, for instance about 20 mm from the length (l) of the objects 14 that are to be printed. The thus predetermined length is then applied to the peripheral surface of the plate cylinder to thereby calculate a center angle ($\delta$) in accordance with said peripheral length. In the next place, the angle index 68 in the sensor device 61 is set on such a position that two indices 67, 68 have an angular distance therebetween that is equal to said angle ($\delta$) as shown in FIG. 7. The heights of both the microswitches ($S_1$) ($S_2$) are to be made equal.

After these arrangements, the continuous rotation of said plate cylinder 11 after the printing has finished causes a synchronous rotation of the angle index 68, which in turn will actuate the microswitch ($S_2$) to energize the translational solenoid 35. Consequently, the rod of said solenoid is retracted by the electromagnetic force into the position shown with the phantom line against the tension of the spring 39 acting to the rod via the link 36. The small bell crank 37 is at the same time swung in the clockwise direction thereby the restricting action of its cam follower 40 against the larger bell crank 28 being released. The torque caused by the tensions of the springs 30, 42 simultaneously swings the crank 28 in the clockwise direction into the position shown by the phantom line. As the result, the tension of said spring 30 is reduced so that the higher tension of the other spring 42 swings the other larger crank 27 also in the clockwise direction into the position shown by the phantom lines. Said crank 27 now acts in a reverse manner contrary to the action in the aforedescribed engaging step. Namely, the crank 27 pulls the actuating lever 25 to the right by means of the link 26 thereby swinging said lever in the clockwise direction by the center angle ($\gamma$). The eccentric necks 19 of the shaft 18 are also rotated by the same degree respectively in their bearing units. Finally, said shaft 18 supporting the impression cylinder 13 is lowered by the distance equal to the value e·sin $\gamma$ whereby the disengagement or removal of said impression cylinder is effected without a hitch.

Under the above removal mechanism for the impression cylinder 13, there is no possibility that the trailing end of the plastic sheet 14 would pass through the printing position before the release of said engagement. The surface of said printing plate 12 can thus be perfectly protected from being damaged by the hard edges of the objects 14 that are to be printed.

As will be understood clearly from the foregoing description, the invented apparatus for engaging the impression cylinder with the plate cylinder has provided a great improvement in the printing technology as summarized hereinafter. The sensor device for indicating and detecting the rotation of said plate cylinder has the adjustable angle indices. They are respectively set at the positions such that they represent an angular distance shorter than the peripheral length of the objects that are to be printed, the length being measured in the forwarding direction thereof. The signal transmitted by one of said indices is applied to the removal or disengagement mechanism for the impression cylinder, the latter being thereby disengaged from the plate cylinder when it is in an angular range between the time when the trailing end of image area of the printing plate just passes through the aforementioned printing point and the time when the trailing end of said object passes through said point. In other words, said trailing end of the object passes through said printing point only after the removal of said impression cylinder in the invention whereas said object usually passes therethrough before said removal in the known apparatuses. Accordingly, a softer printing plate never suffers any sharp linear pressing action otherwise caused in every printing cycle by said trailing edges of thick harder objects such as plastic or metallic sheets. The surface of said printing plate is thus perfectly protected without any possibility that it would be damaged by being bent in the lateral direction to produce fine cracks which occasionally grow into a wider crack. In conclusion, the invention provides a printing machine with the abovedescribed apparatus which is convenient and suitable for engaging and disengaging the impression cylinder with the plate cylinder, especially in case of printing an object such as the plastic or metallic sheet.

What is claimed is:

1. An apparatus for engaging an impression cylinder with a rotating plate cylinder comprising a mechanism by which the impression cylinder is adapted to be disengaged from the plate cylinder in a period between two angular sequential phases of said rotating plate cylinder, wherein the preceding phase being an angular position of said plate cylinder having a printing plate attached thereon where the image area of said printing plate has just passed through a contact point where the cylinders abut each other, whereas the following phase being the other angular position of said plate cylinder where the trailing end of an object that is to be printed is just before said contact point, the object being of sufficient thickness to deform a printing plate on the plate cylinder in the absence of such disengagement.

2. An apparatus set forth in claim 1 further comprising a scale disk, means connecting the scale disc to the plate cylinder so as to rotate synchronously with the plate cylinder and an angle index adjustable to be set at any angular degree graduated on said disk whereby the disengagement of said impression cylinder from the plate cylinder is controlled by means of the angular position of said angle index.

3. An apparatus as set forth in claim 2 wherein said impression cylinder is adapted to engage with said plate cylinder also by means of said adjustable angle index and only at the time after the object has become into contact with said plate cylinder.

* * * * *